United States Patent [19]

Eaton

[11] Patent Number: 4,468,909

[45] Date of Patent: Sep. 4, 1984

[54] BUILDING PANEL

[75] Inventor: James W. Eaton, Sleepy Hollow, Ill.

[73] Assignee: Masonite Corporation, Chicago, Ill.

[21] Appl. No.: 374,190

[22] Filed: May 3, 1982

[51] Int. Cl.[3] ..... E04D 1/00

[52] U.S. Cl. ..... 52/541; 52/105; 52/314; 52/555; 52/558

[58] Field of Search ..... 52/558, 541, 540, 539, 52/555, 559, 314, 527, 105, 554

[56] References Cited

U.S. PATENT DOCUMENTS

| | | | |
|---|---|---|---|
| 3,333,384 | 8/1967 | Brady | 52/540 X |
| 3,868,300 | 2/1975 | Wheeler | 52/555 X |
| 3,927,501 | 12/1975 | Allen et al. | 52/105 X |
| 4,279,106 | 7/1981 | Gleason et al. | 52/521 X |
| 4,366,197 | 12/1982 | Hanlon et al. | 52/527 X |

*Primary Examiner*—Carl D. Friedman

*Attorney, Agent, or Firm*—Mason, Kolehmainen, Rathburn & Wyss

[57] ABSTRACT

A building panel having inner and outer faces outlined by opposite ends and an upper and lower edges has opposite ends adapted to closely face the end of an adjacent panel in the same course. The outer face of the panel includes a lower segment of substantially greater surface area adapted for exposure and an upper portion of relatively smaller surface area adapted to underlie a lower portion of one or more panels in a next higher course laid in overlapping relation therewith. One of the ends of said panel includes an overlap end segment adapted to overlie an underlying end segment at the other end of an adjacent panel laid up end to end in the same course to form a ship lap end joint between the panels. The overlap end segment includes a marginal end portion of the outer face with an underside therebelow formed to slope from a minimum panel thickness adjacent the upper edge toward a maximum panel thickness adjacent the lower edge. The panel includes an underlying end segment at the other end containing a marginal end portion of the inner face with an outer side adapted to underlie a sloping underside of an adjacent panel and formed to slope from a maximum panel thickness adjacent the upper edge toward a minimum panel thickness adjacent the lower edge.

9 Claims, 8 Drawing Figures

BUILDING PANEL

BACKGROUND OF THE INVENTION

1. Field of the Invention

The present invention relates to man-made building panels formed of wood composite materials and more particularly, relates to building panels which are suitable for use as exterior roofing or siding on outside building roof and/or wall surfaces. Each panel is provided with an outer weather surface shaped with a design and grooves which resemble a plurality of shingles or shakes on a roof or wall surface with specially designed end segments adapted to form ship-lap type joints when the panels are laid end to end in a common course or row.

2. Description of the Prior Art

A variety of building wall and roofing panels have been promoted for use in lieu of conventional shingles or shakes which are small in size and require relatively large amounts of installation labor. U.S. Pat. No. 3,796,586 discloses a deep embossed, shingle lap siding formed of pressed wood fibers and U.S. Pat. No. 3,868,300 discloses a composite wall panel laminate having deep indentations in an outer face thereof formed with a tough, outer fibrous skin and a core of relatively course, less dense fibrous material. U.S. Pat. No. 4,279,106 is directed towards a roofing panel with a thin outer shell of hard plastic material formed with a cavity on the underside which is filled with polyurethane foam.

OBJECTS OF THE INVENTION

It is an object of the present invention to provide a new and improved, exterior building panel for installation on sloped roofs and vertical walls.

More particularly, it is desirable to provide a building panel of the character described formed of wood composite material which can be installed with a minimal amount of installation labor and which is aesthetically pleasing to the eye and which resembles a plurality of individual shingles or shakes on a roof or sidewall.

Yet another object of the present invention is to provide a new and improved building panel of the character described which is resistant to wind and water, relatively light in weight, easy to handle and which requires a minimum number of individual panels for a given area or "square" of wall or roofing surface area covered.

Still another object of the present invention is to provide a new and improved building panel of the character described which is essentially self-aligning, easy and quick to install, and which permits ship-lap type end joints between adjacent panels laid end to end in a common course or row.

Still another object of the present invention is to provide a new and improved building panel having an exposed or weather surface shaped or embossed to resemble a plurality of shingles or shakes laid side by side with grooves therebetween and novel end segments for forming ship-lap type joints with adjacent panels laid end to end, which joints are similar in visual appearance to the grooves.

Yet another object of the present invention is to provide a new and improved building panel of the character described which when laid in place minimizes the visibility of joints between the panels and which minimizes the perceptability of a repeating pattern on a wall or roof structure on which the panels are installed.

BRIEF SUMMARY OF THE INVENTION

The foregoing and other objects and advantages of the present invention are accomplished in a new and improved, rectangular building panel formed of wood composite material and having inner and outer faces outlined by opposite ends and upper and lower edges. The panels are adapted to be laid end to end in courses or rows and in overlapping relation from row to row. The outer face of a panel includes a lower portion of substantially greater surface area which is adapted for exposure to the weather and which is shaped or embossed to resemble a plurality of individual shingles or shakes laid side by side with grooves therebetween appearing to the eye as the usual joints between adjacent separate shingle elements. The outer face of the panel also includes a narrow strip or upper portion of relatively smaller surface area which is adapted to underlie a lower portion of the back face of one or more panels laid up in the next higher row or course in overlapping relation therewith forming a head lap.

At least one of the opposite ends of the panel is formed with an overlap end segment adapted to overlie an underlying end segment at the other end of an adjacent panel laid up end to end in the same course to form a ship-lap end joint between panels. The overlap end segment comprises a marginal end portion of the outer face with an underside therebelow formed to slope from a minimum panel thickness adjacent the upper edge toward a larger or maximum panel thickness adjacent the lower edge. The panels also include an underlying end segment at the other end containing a marginal end portion of the inner panel face with an outer side adapted to underlie a sloped underside of an adjacent panel and formed to slope from a maximum panel thickness adjacent the upper edge toward a lesser or minimum panel thickness adjacent the lower edge.

BRIEF DESCRIPTION OF THE DRAWINGS

For a better understanding of the present invention, reference should be had to the following detailed description taken in conjunction with the drawings, in which.

DESCRIPTION OF A PREFERRED EMBODIMENT

Figures 1, 2:
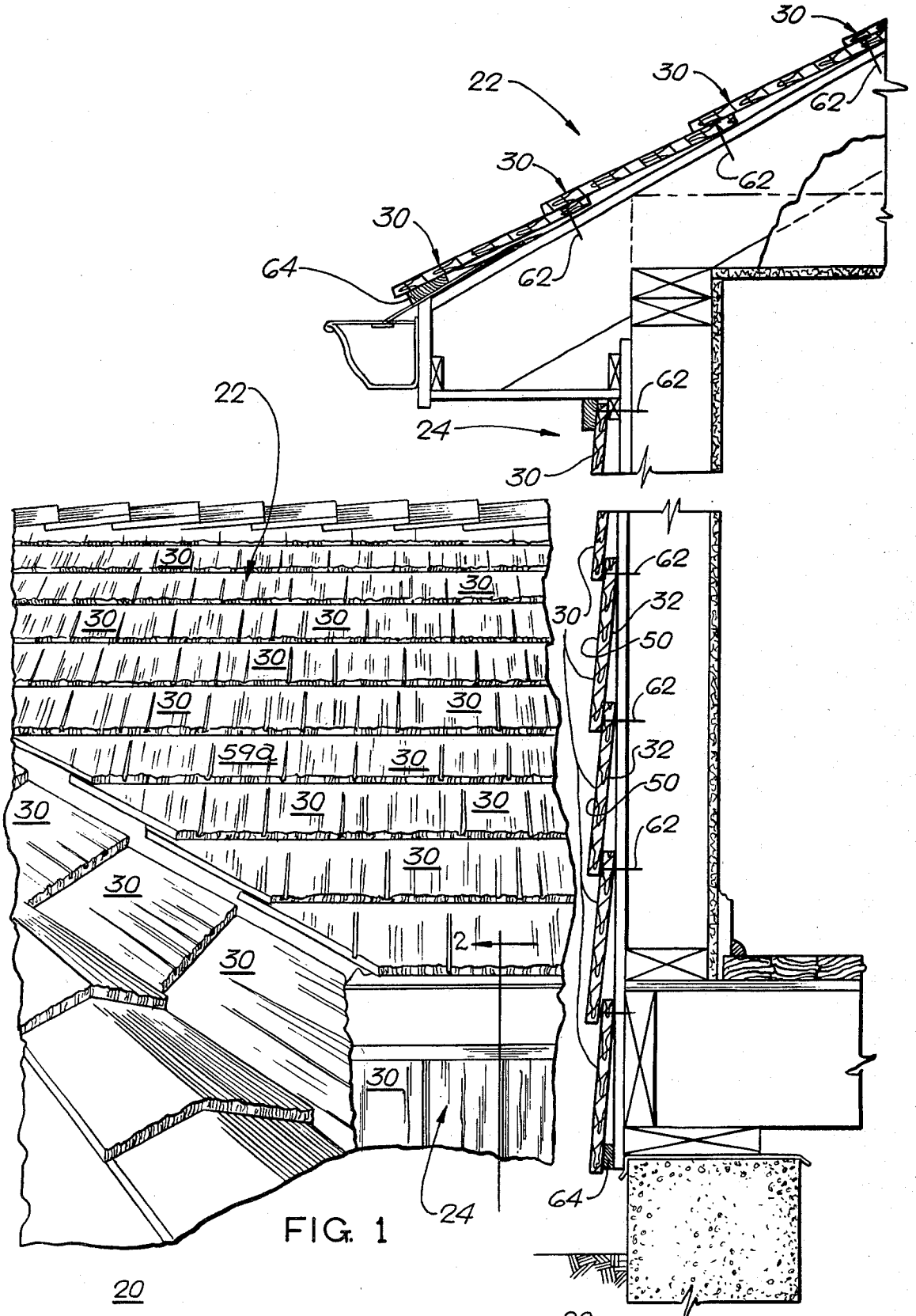
FIG. 1 is a fragmentary elevational view of a typical building structure utilizing building panels in accordance with the present invention laid up in parallel courses or rows in overlapping relation.
FIG. 2 is a vertical cross-sectional view taken substantially along lines 2—2 of FIG. 1.

Referring now more particularly to the drawings, in FIGS. 1 and 2 is illustrated a building 20 of a general or conventional type employing a sloped roof structure 22 and vertical side walls 24. The roof and walls are covered with an outer or weather surface formed by a plurality of new and improved building panels 30 which are laid up in end-to-end relation in horizontal courses or rows. The panels in each succeeding higher course overlap an upper portion of the adjacent lower course or row as best shown in FIG. 2.

Figure 3:
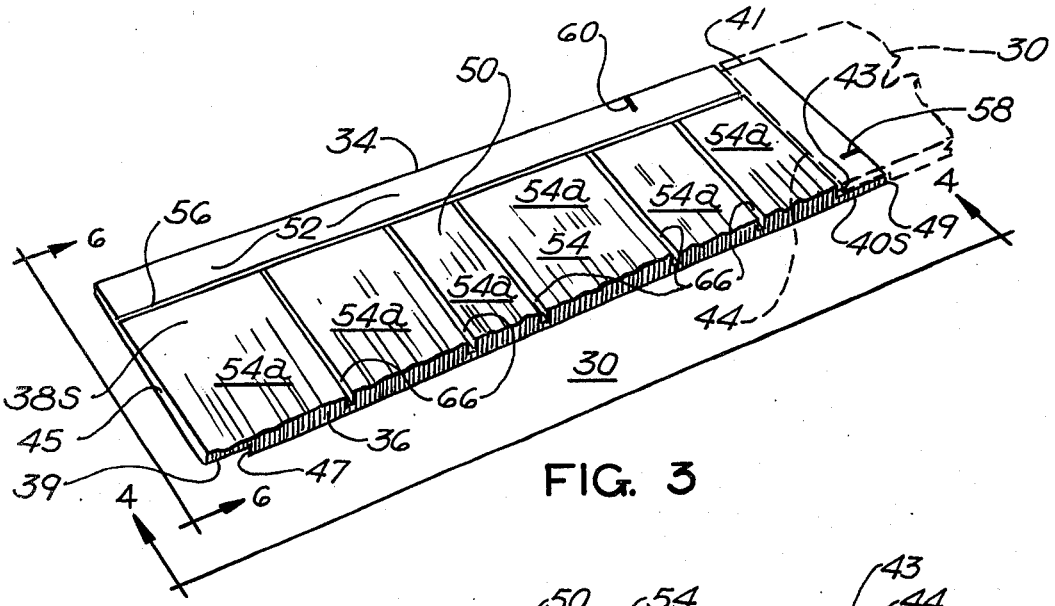
FIG. 3 is a perspective view of one embodiment of a new and improved building panel in accordance with the features of the present invention showing an outer face thereof and a lower butt edge.
Figure 8:
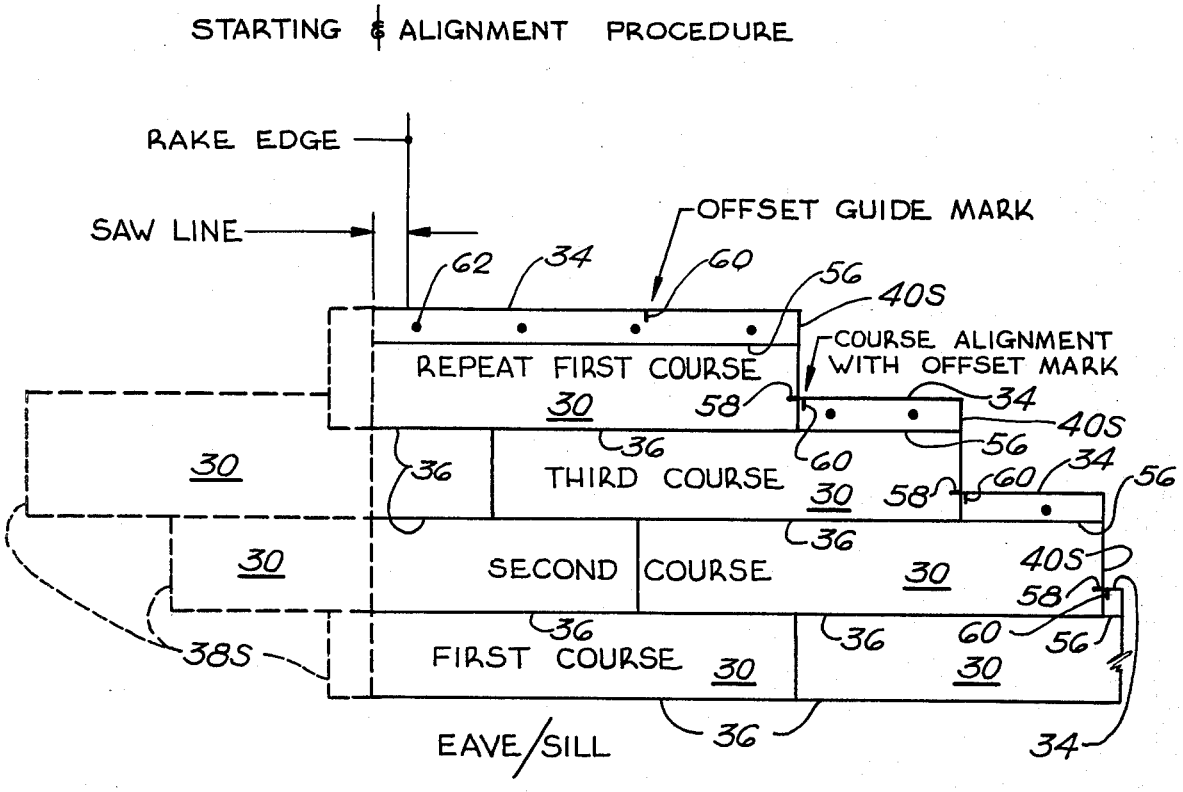
FIG. 8 is a graphic representation of a starting and alignment procedure utilized when installing building panels in accordance with the features of the present invention on a roof or building wall structure.

Each building panel 30 is formed of wood composite material such as flakeboard, chipboard particle board, plywood or hardboard etc. of a substantially uniform thickness and is of a rectangular shape as shown in FIGS. 3 and 8. The panels include a relatively flat or planar back surface 32 bounded by an elongated upper edge or head 34 and a generally parallel, lower or butt edge 36 exposed to the weather. Each panel is formed with an outer or weather face 50 which is generally parallel to the back face except for the minor variations in the thickness because of shaping or embossing, at the grooves as will be described hereinafter, and at opposite end segments.

The outer surface 50 includes a flat, smooth narrow strip or head lap portion 52 along the upper edge and the area of this strip comprises only a fractional or minor portion of the total or overall surface area of the whole building panel. The narrow head lap surface along the upper edge is adapted to underlie a narrow strip of back face along a lower portion of each succeeding panel or panels as they are laid up in place in a next adjacent upper row or course (as shown in FIG. 2). When laid up in place as shown, the narrow overlapping or confronting portions of the panels form a substantially water tight head lap between successive courses or rows of panels on a wall or roof.

The outer weather face of each panel includes a relatively large, lower surface portion 54 lying below the narrow upper head lap 52 and delineated therefrom by a thin, marker line or shallow groove 56 parallel of and spaced between the upper edge 34 and the lower, exposed butt edge 36. The shallow groove or guide line 56 provides guidance for aid in aligning subsequent rows or courses of panels on a building wall or roof surface. The panels 30 are provided with a course alignment end mark or short line 58, normally located at the right hand end. These course alignment marks are aligned with the upper edges 34 of panels in the next lower course or row as a roofing or siding job proceeds.

In accordance with the present invention the weather or exposed outer face 54 of the outer surface 50 is shaped, preferably by deep embossing to resemble closely in appearance, a plurality of individual shingle or shake elements **54*a* of random width and order, laid up in side by side relation in a common row or course as illustrated. Each shingle element terminates along a lower butt edge coincident with the edge of the whole building panel and between each pair of adjacent individual shingle elements embossed in the outer surface 54, there is provided a tapered groove or channel 66 which is dimensioned to taper from a shallow or minimum depth at the upper end adjacent the nailing guide groove or line 56 to a greater or maximum groove depth adjacent the lower or butt edge 36 of the building panel. Each groove breaks out or becomes substantially even with the outer surface of the adjacent pair of embossed shingle elements 54*a*** on each side just before reaching the level of the nailing guide line.

The tapered grooves provide deep relief at the lower or butt edge of the panels resulting in an overall appearance remarkably indistinguishable from that of a plurality of cedar shakes or shingles on a wall or roof surface. Along the relatively thick, butt edge 36 of each panel, the grooves 66 between each pair of adjacent embossed shingle elements may reach a maximum depth, and preferably this depth is less than the nominal thickness of the panels overall.

The tapered, deepening grooves form a thick shadow appearance which truly and accurately visually resembles a building surfaced with individual shingles or cedar shakes. Because the grooves taper to a minimum depth and break out at the upper end thereof adjacent the nail guide line before reaching the head lap strip area, there is little chance that wind driven water will be forced under the head lap between adjacent courses of panels. Instead, any water will tend to spill out from the sides of the grooves at the shallow upper end and then run back down the outer faces of the adjacent shingle elements on either side of the groove.

The unique grooves 66 also provide another enhancing feature in that the building panel 30 is dimensioned to retain full nominal thickness uninterrupted for the entire length thereof above the nailing guide grooves 56 and in this area 52, fastening attachment to a building wall or roof is accomplished along the strongest portion of each panel. The panels are thus strong where needed and are not subject to peel-up or fish mouthing which is a problem with many shingles and roofing materials.

Each panel also includes a course offset guide mark 60 formed on the outer weather face 50 and positioned in the upper head lap or strip 52 adjacent the upper edge 34. The guide marks 60 are preferably located at a distance approximately $\frac{1}{3}$ of the total length of a panel along the upper edge inwardly from the right hand end. As illustrated in FIG. 8, the course offset guide mark on the upper edges of the panels laid in the first course are used for aligning the right hand ends of the panels in the second course. Similarly offset guide marks in the panels of the second course are used for aligning the right hand ends of the panels in the third course.

When the course offset guide marks 60 are spaced approximately $\frac{1}{3}$ of the total length of the panels inwardly from the one end thereof, the course orientation of the panels repeats itself every third course or row that is applied on a wall or roof structure. The positioning of the course offset guide marks on a panel can be changed to a different end spacing, for example, a random spacing basis, if desired, but at somewhat increased production expense. If this is done there will be little chance of any periodic repetition of succeeding courses and a truly random pattern will result. However, it has been established that a repeat of course orientation every third course or row is almost imperceptible to the eye and provides a truly aesthetic as well as an economical weather covering for a building.

Figure 4:
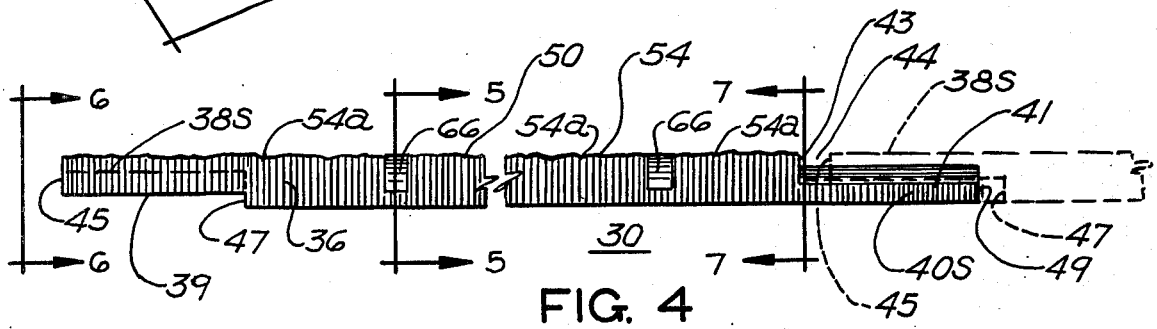
FIG. 4 is a lower edge elevational view of the panel of FIG. 3 looking in the direction of arrows 4—4 of FIG. 3.

The building panels 30 include ship-lap type overlapping end segments 38S at one end (lefthand end) adapted to overlay an underlying end segment 40S on the opposite (righthand end) of a next adjacent panel 30 in the same course or row to form an overlapping ship-lap type joint therewith as best shown in FIGS. 3 and 4.

The overlapping end segments 38S extend between the upper and lower edges 34 and 36 of the panels 40 and are provided with a flat or substantially planar underside 39 designed to overlap an upper side or surface 41 in a close fitting relationship when the panels are laid end to end forming ship-lap type joints therebetween.

Figure 6:
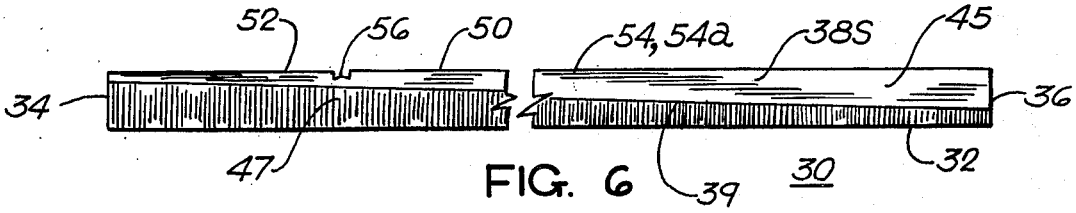
FIG. 6 is an end elevational view of the panel of FIG. 3 looking in the direction of arrows 6—6 of FIG. 3.
Figure 7:
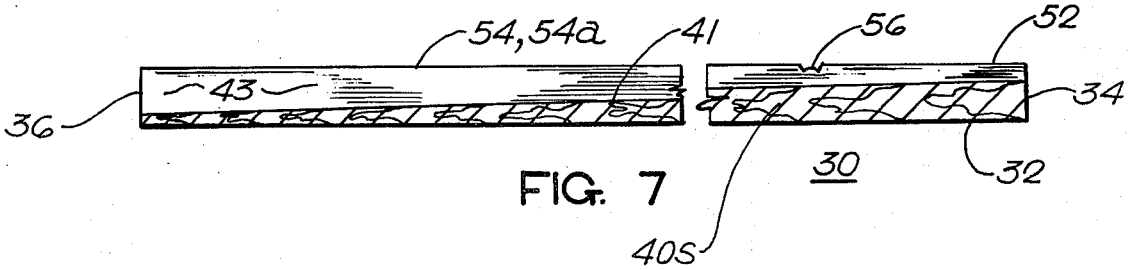
FIG. 7 is a cross-sectional view of the panel taken along lines 7—7 of FIG. 4.

As best shown in FIGS. 6 and 7, the surfaces 39 and 41 are sloped or tapered from a minimum amount of depth or spacing at the upper edges 34 of the panels down from the outer face 50 to a greater or maximum amount of spacing or depth at the lower panel edges 36. When the panels are laid up in end to end relation as illustrated in FIGS. 3 and 4, grooves or open spaces 44 are provide between directly facing inner end faces 43 above the underlying end segment 40S and an outer end face 55 of the overlapping end segment 38S of an adjacent panel. The expansion spaces 44 appear similar to and generally indistinguishable from the tapering grooves 66 between adjacent shingle surface elements 54*a* in the body of the panel.

The overlapping end segments 38S also include an inner end surface 47 parallel to the upper outer end surface 45 and normal to the underside 39. Similarly, the underlying end segments 40S at the opposite or right-hand end of the panel include outer end faces 49 which are parallel with the faces 43 and normal to the sloped outer surface 41. When the panels 30 are laid up end to end in a single row or course as shown in detail in FIGS. 3 and 4 the underside 39 of the overlapping end segment 38S is in contact against the outer side 41 of the underlying end segment 40S of an adjacent panel and this tight planar contact between these surfaces provides a water tight, ship-lap type overlapping joint with a tapered groove or expansion space 44 formed between adjacent facing surfaces 43 and 44.

Figure 5:
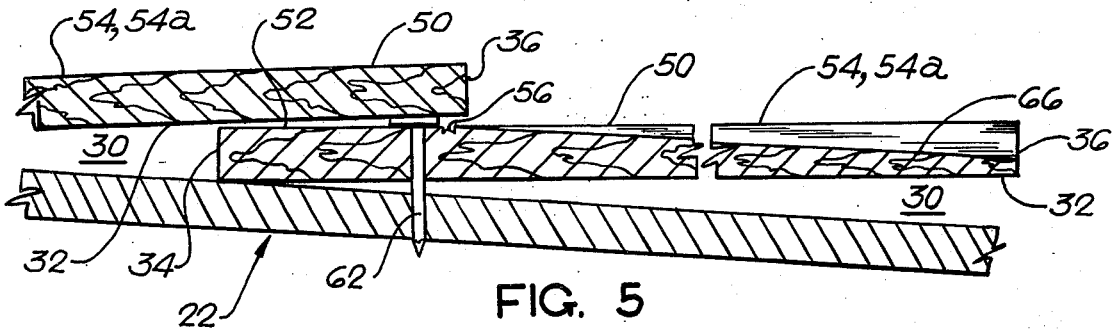
FIG. 5 is a cross-sectional view of a building wall or roof structure illustrating the cross-section of a pair of building panels, one of which is laid up in an overlapping course or row in relation to the other.

As best illustrated by comparing the view in FIG. 5 with the views of FIGS. 6 and 7, it is seen that the angle of slope or taper of the bottom of the grooves 66 relative to the outer panel face 50 is somewhat greater than the slope of the surfaces 39 and 41 on the overlap end segment 38S and underlying end segment 40S respectively. However, the difference in slope angle is only a slight amount and is virtually imperceptable when a roof or wall is surfaced with the panels. The spacing 44 between the panel end faces 43 and 45 can be established to be approximately the same as the width of the grooves 66 making it even more difficult to tell which is a joint between panel ends and which is a groove between shingle or shake elements 54*a*.

It should also be noted that the thinner portion of the underlying end segment 40S is positioned at the lower corner and if this corner is damaged or broken off during application or handling of a panel, the broken off area will be covered by a thicker and stronger lower corner of the overlap end segment 38S so as to be virtually unnoticeable. This feature greatly reduces losses which might otherwise be caused by rough handling of the panels 30. Similarly, if the upper corner of the relatively thin portion of the overlap end segment 38S is broken off or damaged, the broken off area will be covered over so as to be substantially unnoticable by the overlapping portion of the panel(s) in the next higher course or row of panels applied.

As illustrated in FIG. 8, a roof or building wall structure is surfaced with the building panels 30 by applying a first course along a lower edge or eave with a left hand end 38S extended outwardly beyond a "saw line" which in turn is spaced outwardly of a rake edge of the building. Successive panels in the first course are then laid end to end along the row. A second course is started with the left hand end 38S of a first panel in the course extended outwardly to the left even beyond the left hand end of the end panel in the first course. Similarly, the left end panel in the third course extends outwardly to the left farther than the starter panel of the second course. Eventually these outwardly projecting panel end portions are cut of along the "saw line". The cut off portions may sometimes be utilized at the opposite (right hand) end of the course or on other parts of the structure depending upon the lengths thereof and distance coverage required. The application process as described may also be initiated from a right hand corner along the lower edge or eave and the panels may be aligned end to end in each course or row from right to left proceeding to the lefthand rake edge of the building or roof structure.

As illustrated, the course alignment marks 58 of panels 30 in the second course are positioned over the upper edges 34 of the panels in the first course and this aids a roofer in establishing precise parallel alignment of the lower or butt edges 36 of the panels in each succeeding course. The butt edge of panels in the second course are also visually aligned with the shallow grooves or nail marker lines 56 in the panels of first course to further insure hat each succeeding course is precisely parallel to the last. The lines 56 and end marks 58 thus function cooperatively to aid an installer in easily establishing the precise and proper, but minimal amount of headlap or overlap between the panels as they are installed in each succeeding course or row.

In applying the panels on a roof or wall surface it is recommended that the panels be installed over a minimum base of ½ inch thick CDX plywood or equivalent sheathing or decking. The sheathing or decking should also be covered with a layer of 15 pound asphalt felt or similar material prior to installation of the panels thereon. Nails or staples 62 are used to secure the panels in place and these fasteners are driven above the nailing line or groove 56 in the narrow, head lap or strip area 52, so as not to be exposed to the weather. Generally, galvanized roofing nails or staples are recommended, and normally five or six spaced apart fasteners are used to hold a 48" long building panel in place.

In practice, panels having a nominal length of 48 inches are easily handled by one person alone. Along the lower edge of a building wall or the eave of roof structure, a narrow starter strip 63 is utilized for the first course and a lower edge of the starter strip is spaced a short distance upwardly above the lower or thick butt edge 36 of the panels of the starter course as illustrated in FIG. 2.

In a typical commercial embodiment of the present invention, panels 30 are dimensioned to be approximately 47 and 3/16th inches in length and 11 and 13/16th inches in width with a 3 inch wide head lap being provided between the upper edge 34 and the nail guide grooved line 56. The panels are nominally 7/16th inches thick and are packaged with 6 panels per bundle. In this size, only 6 bundles are required to cover 100 square feet or one "square" of a building roof or wall structure. Panels having these size parameters produce a weight of approximately 240 pounds per "square" of surface area covered. This weight is comparable to that of many asphalt shingles but the panels 30 provide a great advantage in terms of the small number of pieces (36) necessary for covering a "square" of surface area.

The panels are recommended for use on roof slopes of 4 in 12 or steeper and are economical for use in new construction as well as for re-siding or re-roofing application over old materials already in place.

The sloped or tapered surfaces 39 and 41 of the end segments 38S and 40S provides strength where most needed to protect against damage from rough handling and even if corners of thinner portions are broken off or cracked, the panels may still be usable as previously described because the broken off areas will generally be covered and protected from the weather by an overlapping panel. The spaces 44 between panel ends and the grooves 66 within a panel body are virtually indistinguishable when the panels are installed on a roof or wall and this provides an extremely pleasing appearance similar to that of a high quality wall surface of shingles or cedar shakes, but with much lower application and labor costs.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. A building panel formed of a single piece of fibrous wood material pressed to a substantially uniform thickness overall between generally parallel and opposite, inner and outer faces outlined by opposite ends and by upper and lower edges, said opposite ends of said panel adapted to closely face the end of an adjacent panel in the same course, said outer face having a relatively large lower segment with a surface adapted for exposure and an area substantially larger than a long, narrow upper edge segment having a relatively smaller flat surface area adapted to underlie a lower inner face portion of one or more panels in a next higher course laid in overlapping relation therewith, said lower segment having an embossed irregular surface area formed to resemble a plurality of individual shingle-like elements laid side by side in a common course and separated by tapered grooves, said grooves tapering from a minimum depth adjacent an upper edge of said lower segment toward a maximum depth adjacent a lower edge of said panel for providing the appearance of a course of tapered, thick butt shakes or shingles, one of said ends of said panel including an overlap end segment adapted to overlie an underlying end segment at the other end of an adajcent panel laid up end to end in the same course to form a ship lap end joint between said panels, said overlap end segment at said one end containing a marginal end portion of said outer face with an underside therebelow formed to taper in a direction generally similar to the taper of said grooves from a minimum thickness adjacent said upper edge toward a maximum thickness adjacent said lower edge, said panel including an underlying end segment at the other end containing a marginal end portion of said inner face with an outer side adapted to underlie said tapered underside of an adjacent panel and formed to taper in a direction generally similar to the taper of said grooves from a maximum thickness adjacent said upper edge toward a minimum thickness adjacent said lower edge, whereby a plurality of said panels laid end to end in a common course with the overlap end segment of one panel overlapping an underlying end segment of an adjacent panel providing a tapered joint groove between the adjacent ends of said panels similar in appearance to said tapered grooves between adjacent shingle-like elements within each of said panels.

2. The building panel of claim 1 wherein said overlap end segment includes spaced apart inner and outer ends normal to and intersecting said underside, said underlying end segment including inner and outer ends normal to and intersecting said outer side.

3. The building panel of claim 1 wherein said tapered grooves are open at the lower end on said lower edge of said panel.

4. The building panel of claim 1 wherein said panel is dimensioned to have a thickness at the lower end of said grooves which is similar to the panel thickness of said underlying end segment adjacent the lower edge of said panel.

5. The building panel of claim 1 wherein said tapered grooves have upper ends terminating at or below said upper segment of relatively smaller surface area of said outer face.

6. The building panel of claim 5 wherein said tapered grooves break out onto said outer face of said panels at or below said upper segment of relatively smaller surface area.

7. The building panel of claim 1 wherein said underside of said overlapping end segment and said outer side of said underlying segment are substantially flat and extend between said upper and lower edges of said panel.

8. The building panel of claim 1 wherein the thickness of said panels is less than said substantially uniform thickness overall at said tapered grooves and at said end segments.

9. The building panel of claim 1 including a course offset guide mark along said upper edge spaced a selected distance from one of said end segments on said upper segment of relatively smaller surface area of said outer face.

* * * * *